US006346051B1

(12) United States Patent
Otsubo

(10) Patent No.: US 6,346,051 B1
(45) Date of Patent: Feb. 12, 2002

(54) STAND FOR GOLF CLUBS AND ACCESSORIES

(76) Inventor: Hirofusa Otsubo, 60-16 83rd Pl., New York, NY (US) 11373

( * ) Notice: Subject to any disclaimer, the term of this patent is extended or adjusted under 35 U.S.C. 154(b) by 0 days.

(21) Appl. No.: 09/572,659

(22) Filed: May 16, 2000

(51) Int. Cl.[7] ..... A63B 55/04; A63B 55/10

(52) U.S. Cl. ..... 473/282; 211/70.2; 248/156; 248/688

(58) Field of Search ..... 473/282, 286; 211/70.2, 21.2; 248/156, 530, 520, 688; 172/378; D21/176; D6/552

(56) References Cited

U.S. PATENT DOCUMENTS 3,586,274 A * 6/1971 Hart
3,612,455 A * 10/1971 Cole
3,828,373 A * 8/1974 Fraley
4,953,906 A * 9/1990 White
5,127,530 A * 7/1992 Ortuno
5,149,087 A * 9/1992 Thompson
5,188,340 A * 2/1993 Green
D363,849 S * 11/1995 Bruns
5,467,980 A * 11/1995 Weisenstein
D400,612 S * 11/1998 Rubin
5,873,471 A * 2/1999 Ruggeri
D418,186 S * 12/1999 Canterbury

* cited by examiner

*Primary Examiner*—Stephen Blau
(74) *Attorney, Agent, or Firm*—Robert J. Bird

(57) ABSTRACT

A golf club stand is a single rod member which includes the following segments in series: a point at the lower end of the rod; a leg extending up from the point, a 180° bend; an arm depending from the bend; a first lateral member extending from the depending arm; a loop at the end of the first lateral member; a second lateral member extending from the loop; an upright arm extending from the second lateral member; and a coil at the end of the upright arm. The 180° bend between leg and arm forms a hook to hang the device on the upper rim of a golf bag, for storage. The first and second lateral members are spring biased against each other by the loop to releasably hold a towel between them. The arms and said second lateral member together form a U-shaped enclosure to confine the handle of a standing golf club. The coil provides a temporary holder for a smoker's pipe, cigar, cigarette, or the like. A club face cleaner brush is removably hung on the loop. The device further includes a bright light-reflective coating.

6 Claims, 2 Drawing Sheets

STAND FOR GOLF CLUBS AND ACCESSORIES

BACKGROUND OF THE INVENTION

This invention is a golfing equipment accessory, and more specifically a portable golf club stand.

Prior art that I know of includes the following U.S. Pat. Nos.: 5,127,530 (Ortuno); 5,597,363 (Leote); Des 363,849 (Bruns); Des 400,612 (Rubin); Des 418,186 (Canterbury). U.S. Pat. No. 5,127,530 (Ortuno) appears to be the most relevant of these.

Ortuno discloses a portable golf club stand which includes a rod 4 to be stuck in the ground, the upper part of the rod including a U-shaped enclosure 14 to support the handles of one or more golf clubs as they stand on the ground. The enclosure 14 is folded back on the rod 6, forming a 180° bight which straddles the upper rim of the golf bag when the device is not in use and stands in the golf bag with the clubs. The Ortuno device further includes a wind indicator flag.

If a player is using a golf cart, and especially when a single cart is used by two players, one player often has occasion to leave the cart to go to his ball in one area, such as the rough or woods on one side of the fairway, while the other player stays with the cart to go in another direction to his ball. The first player may need two or more clubs for this excursion, and so a golf club stand as mentioned above is a convenient device to keep those clubs upright, off the ground, dry, and visible. Visibility is a significant factor if the ball is in such a bad lie that the player leaves his clubs to search for it.

SUMMARY OF THE INVENTION

A golf club stand according to this invention is a single rod member which includes the following segments in series: a point at the lower end of the rod; a leg extending up from the point, a 180° bend; an arm depending from the bend; a first lateral member extending from the depending arm; a loop at the end of the first lateral member; a second lateral member extending from the loop; an upright arm extending from the second lateral member; and a coil at the end of the upright arm. The 180° bend between leg and arm forms a hook to hang the device on the upper rim of a golf bag, for storage.

The first and second lateral members are spring biased against each other by the loop to releasably hold a towel between them. The arms and said second lateral member together form a U-shaped enclosure to confine the handle of a standing golf club. The coil provides a temporary holder for a smoker's pipe, cigar, cigarette, or the like. A club face cleaner brush is removably hung on the loop. The device further includes a bright light-reflective coating.

DETAILED DESCRIPTION

Figure 1:
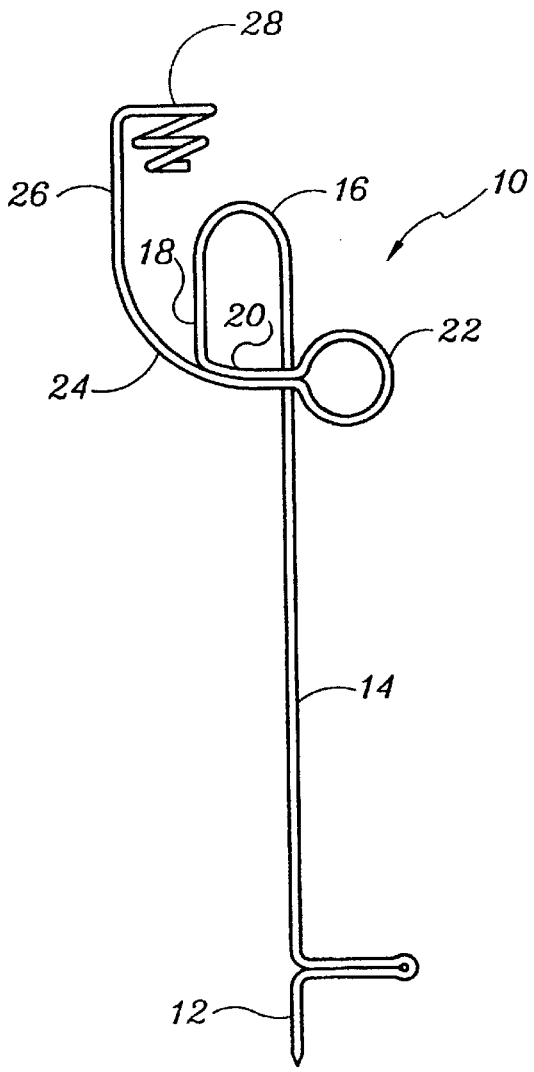
FIG. 1 is an elevation view of a golf club stand according to this invention.

Referring now to the drawing, my golf club stand 10 is a single piece cylindrical rod, bent into the configuration shown and including the following segments in series: a point 12 at its lower end, a main upright leg 14, a bend 16 of 180°, an arm 18 depending from the bend 16, a first lateral member 20 extending from the depending arm 18, a loop 22, a second lateral member 24, an upright arm 26, and a helical coil 28. The golf club stand is preferably of a single piece or rod of steel or synthetic polymer.

Figure 3:
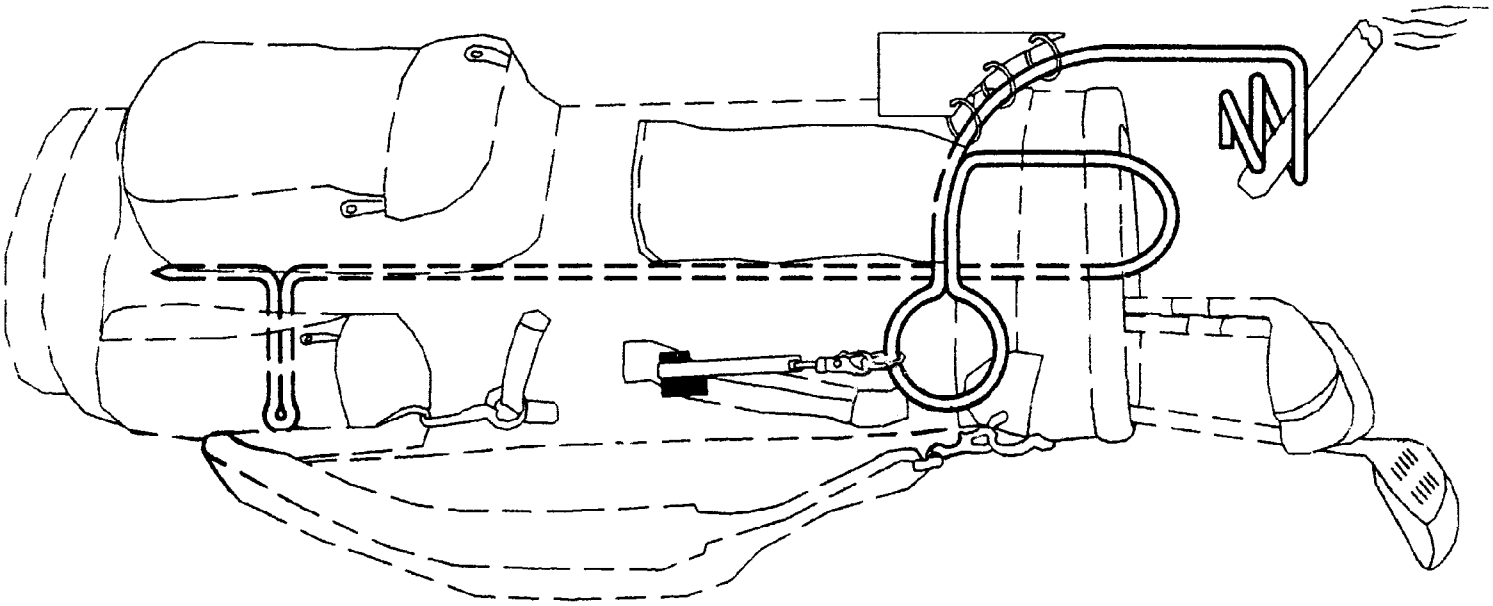
FIG. 3 shows the golf club stand in a storage position within a golf bag.

The leg 14 and arm 18 are spaced apart by the bend 16 so that they straddle the upper rim of a golf bag (FIG. 3) to secure the device in its storage position within the bag.

The lateral members 20 and 24 are spring-biased against each other by the loop 22 which connects them and acts as a spring urging them together to releasably secure a towel 30. The loop 22 provides a place from which to hang a club face cleaner brush 32, tee pack (not shown), or other convenience (FIG. 2).

Figure 2:
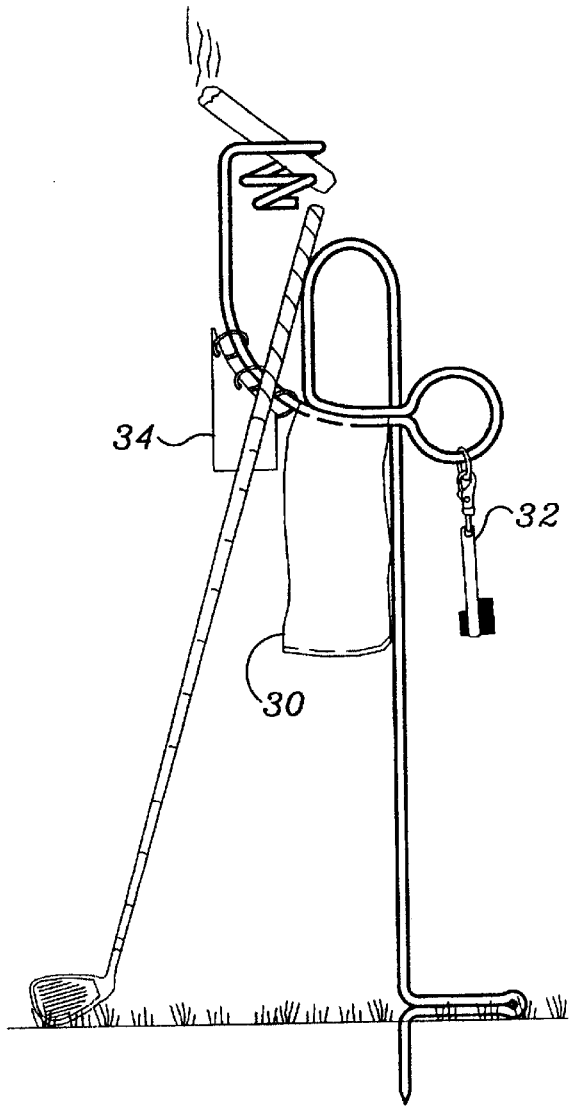
FIG. 2 is similar to FIG. 1, showing the stand in use with a golf club, towel, cigar, name tag, and club face cleaner brush.

The arms 18 and 26, and the connecting lateral member 24 together form a U-shaped enclosure to support and confine the handles of one or more golf clubs (FIG. 2).

The coil configuration 28 at the top end of the device is a temporary holder for a pipe, cigar, or cigarette, to keep it clean and dry while the player is shooting.

A name tag 34 to identify the owner of the equipment is hung from the second lateral member 24.

I prefer that the golf club stand, (that is to say, the rod) be coated with a bright highly reflective coating, or a phosphorescent coating to make the device visible at night by flashlight.

These last two features (the name tag for identification, and the reflective coating for visibility) are significant because golfers do occasionally leave clubs behind when they are distracted.

The term "coil" in the foregoing description and in the following claims is intended to encompass any wire or rod configuration to serve as a cradle; the term is not intended to imply or connote only a helical coil.

The foregoing description of a preferred embodiment of this invention, including any dimensions, angles, or proportions, is intended as illustrative. The concept and scope of the invention are limited only by the following claims and equivalents thereof.

What is claimed is:

1. A golf club stand formed of a single piece rod member, including the following segments in series, from bottom to top of said rod:

a point, an upright leg, a 180° bend, an arm depending from said bend, a first lateral member extending from said depending arm, a loop at the end of said first lateral member, a second lateral member extending from said loop, an upright arm extending from said second lateral member, and a coil at the end of said upright arm;

said leg and said depending arm adapted to straddle the upper rim of a golf bag to secure said golf club stand in a storage position therein;

said first and second lateral members biased against each other by said loop to releasably secure a towel therebetween;

said arms and said second lateral member together forming a concavity to confine the handle of a standing golf club; and said coil adapted to hold a smoker's pipe, cigar, or cigarette.

2. A golf club stand as defined in claim 1, further including a club face cleaner brush removably connected to said loop.

3. A golf club stand as defined in claim 1, further including a bright light-reflective coating on said rod member.

4. A golf club stand formed of a single piece rod member, including the following segments in series:

a point at the lower end of said rod, a leg extending up from said point, a 180° bend, an arm depending from said bend, a first lateral member extending from said depending arm, a loop at the end of said first lateral member, a second lateral member extending from said loop, an upright arm extending from said second lateral member, and a coil at the end of said upright arm;

said leg and said depending arm adapted by said bend to straddle the upper rim of a golf bag to secure said golf club stand in a storage position therein;

said first and second lateral members being spring biased against each other by said loop to releasably secure a towel therebetween;

said arms and said second lateral member together forming a U-shaped enclosure to confine the handle of a standing golf club; and said coil providing a temporary holder for a smoker's pipe, cigar, or cigarette.

5. A golf club stand as defined in claim 4, further including a bright light-reflective coating on said rod member.

6. A golf club stand as defined in claim 4, further including a club face cleaner brush removably connected to said loop.

* * * * *